US005435047A

United States Patent [19]

Colpo

[11] Patent Number: 5,435,047

[45] Date of Patent: Jul. 25, 1995

[54] LOCK FOR BRACELETS, NECKLACES AND THE LIKE

[75] Inventor: Renzo Colpo, Sovizzo, Italy

[73] Assignee: Colpo & Zilio SRL, Torri Di Quartesolo, Italy

[21] Appl. No.: 237,769

[22] Filed: May 4, 1994

[30] Foreign Application Priority Data

Feb. 9, 1994 [IT] Italy ..... VI94A0016

[51] Int. Cl.[6] ..... A44B 11/00

[52] U.S. Cl. ..... 24/647; 24/616; 24/650

[58] Field of Search ..... 24/647, 650, 643, 684, 24/609, 645, 615, 616

[56] References Cited

U.S. PATENT DOCUMENTS

| | | | |
|---|---|---|---|
| 408,308 | 8/1889 | Keller | 24/647 |
| 468,677 | 2/1892 | Maxheimer et al. | 24/647 |
| 1,807,293 | 5/1931 | Keller | 24/616 |
| 2,635,315 | 4/1953 | Kaufman | 24/647 |
| 2,933,795 | 4/1960 | Meeker | 24/647 |
| 3,638,287 | 2/1972 | Wright et al. | 24/647 |

FOREIGN PATENT DOCUMENTS

| | | | |
|---|---|---|---|
| 1127998 | 12/1956 | France | 24/647 |
| 0410208 | 4/1947 | Italy | 24/647 |
| 0668253 | 9/1964 | Italy | 24/647 |

*Primary Examiner*—Victor N. Sakran

*Attorney, Agent, or Firm*—Watson, Cole, Grindle & Watson

[57] ABSTRACT

The invention is a lock for pieces of jewellery and bijouterie and consists of a first element (2; 300) connected with one end of one of said articles and of a second element (3; 400) connected with the other end of the same article, elements which are joined together by means of coupling devices. Said coupling devices consist of a male element (35; 335) that belongs to said second element and couples in a corresponding seat (23; 323) belonging to said first element by means of elastic elements (5; 500) that in turn allow said elements to join together by means of a snap, but prevent them from separating after coupling.

12 Claims, 3 Drawing Sheets

LOCK FOR BRACELETS, NECKLACES AND THE LIKE

DESCRIPTION

The invention is a lock for pieces of jewellery or bijouterie, particularly suitable for being mounted on necklaces, bracelets and the like.

From the point of view of manufacture, the known kinds of lock can be substantially divided into three groups: spring-catch locks, locks with elastic ring and box locks. As far as the so-called spring-catch locks are concerned, they consist of a ring provided with an open part that can be closed by means of a mobile element preventing the perforated element coupled with said ring from separating. On the other hand, the locks with elastic ring consist of a closed ring joining together with a tubular element that is shaped as a broken ring and, in its inside, has an elastically sliding shutter that restores the continuity of the ring in the broken part.

In one of its positions this sliding shutter keeps the broken part open and allows said closed ring to couple with said shaped tubular element, while in another position it closes said broken part and prevents the separation of said tubular element from said closed ring.

Finally, as far as box locks are concerned, they consist of a hollow receiving element into which a coupling elastic element is introduced, said coupling elastic element being provided with a projection suitable for being introduced with a snap into a housing obtained in the hollow receiving element.

All the known kinds of lock that have been described above are characterized by the same drawback: the mobile parts that make them up are provided with projections for clasping, in order to exert the force necessary to open or close them, and said projections can easily get entangled in the clothes of the person who is wearing the object and can therefore cause the accidental opening of the lock, at the risk of losing the object.

Furthermore, another drawback lies in the fact that these locks cannot always be manufactured with shapes suitable for fitting the object on which they are mounted.

It is to get over such drawbacks that this invention has been accomplished.

In particular, the main purpose of the invention is to carry out a lock for pieces of jewellery and/or bijouterie, such as bracelets, necklaces and the like, that can be opened only intentionally by the user.

Another aim is to obtain a lock that can have any shape, so as to fit the elements or the parts that make up the object on which it is mounted.

The aims described above have been achieved by means of a lock for pieces of jewellery and/or bijouterie, in particular for bracelets, necklaces and the like, which, according to the main claim, includes a first element connected with one end of one of these articles and provided with a projection suitable for being introduced into an opening belonging to a second element consisting of a hollow body that is connected with the other end of the same object and cooperates with a cover by means of a hinge and of interposed elastic elements; the lock is characterized in that said cover is provided with a male element coupling in a corresponding seat made in said projection in order to accomplish a stable connection between said elements when said elastic elements make said cover return and close against the hollow element through rotation around said hinge, after said projection has been introduced into said opening.

According to a practical application the hinge connecting said cover with said hollow element is placed in correspondence with one end of the lock and consists of a pivot driven through holes made both in the cover and in the hollow element. Therefore the cover is opened and closed by raising and lowering it, respectively, and both movements take place with a compass-like rotation with respect to said hollow element with which it is connected. In particular, the raising of the cover takes place through an intentional movement of the user, while its lowering takes place automatically owing to the returning action of the elastic elements set between said cover and said hollow element.

According to another practical application, the hinge connecting said hollow element is placed in correspondence with an area of said lock which is intermediate and substantially central and even in this case it consists of a pivot driven through holes made both in the cover and in the hollow element. Therefore the cover is opened and closed by raising and lowering it, respectively, and both movements take place with a rotation of said cover with respect to said hollow element around said hinge. In particular, the raising of the cover takes place when the user exerts a pressure on the cover on one side of the hinge, while its lowering takes place automatically owing to the returning action of the elastic elements set between said cover and said hollow element.

To advantage, the lock that is the object of the invention, having no points that can get entangled, is almost completely safe from accidental opening.

Considering its practical application, in both the variants the lock object of the invention can advantageously be accomplished with any shape fitting the shape of the object on which it is mounted.

The aims and the advantages described above will be better highlighted in the description of a practical application among many of the invention in question, illustrated in the attached tables:

Figure 1:
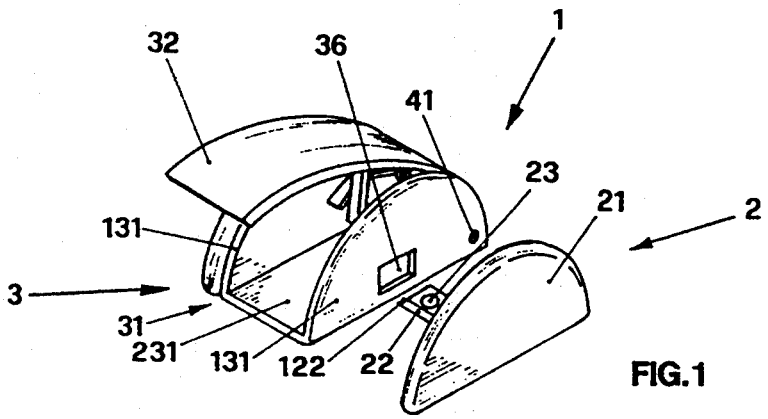
FIG. 1 shows an axonometric view of the lock object of the invention when open.

As shown in FIG. 1, the lock object of the invention, referred to as a whole by 1, consists of a first element, referred to as a whole by 2, and of a second element, referred to as a whole by 3, each of which is linked to one end of an object, which may indifferently be a bracelet, a necklace or the like, by means of linking elements, which are not represented and can be of any kind.

Figure 2:
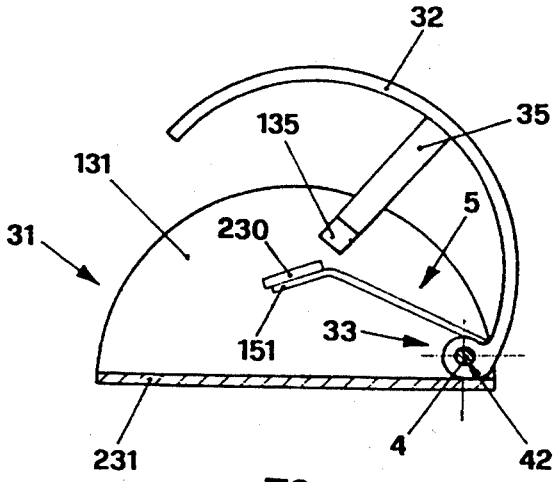
FIG. 2 shows a section of the lock object of the invention when open.

It can be noticed, in particular, that said first element 2 consists of a body 21, which can have any shape and is provided with a projection 22 in which a through hole 23 is made and that, on the other hand, as also FIG. 2 shows, said second element 3 consists of a hollow element 31, which can have any shape, too and cooperates with a cover 32.

According to a practical application said through hole 23 made in said projection can be replaced with a seat of any shape or dimension, such as, for example, a notch, made in the projection 22 as well.

Said hollow element 31 and said cover 32 are connected with each other by means of a hinge 33 that is placed in correspondence with one end of the second element 3 and consists of a pivot 4 coupling internally through the holes 41 and 42 made in the walls 131 of the hollow element 31 and in the cover 32, respectively.

Figure 3:
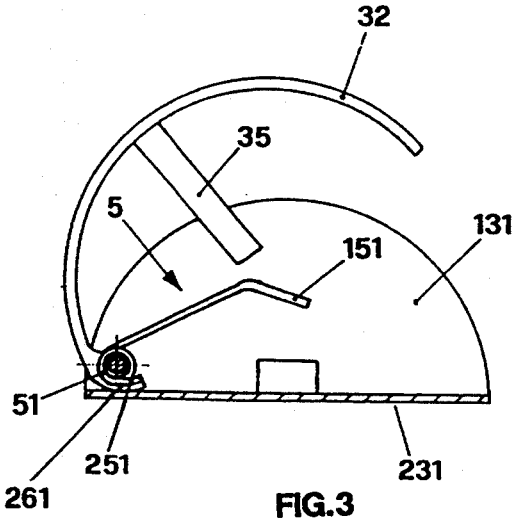
FIG. 3 shows a section of the lock object of the invention when open, seen from the side on which the locking spring is mounted.

In correspondence with said hinge 33, as shown in detail in FIGS. 2 and 3, there is an elastic element consisting of a spring 5 having its central part 51 wound in correspondence with the hinge 33, while one of its ends 151 is set in opposition to a locking element 230 belonging to the hollow element 31 and the other end is set in opposition to the end 261 of the cover 32.

Therefore the cover is opened and closed by being raised and lowered, respectively, with a movement which takes place with a compass-like rotation around said hinge 33. In particular, the opening of the cover occurs when the user intentionally raises it, while the lowering of said cover takes place automatically because of the elastic returning action of the spring 5.

It can also be noticed that, in its internal part facing the concave part of the hollow element 31, said cover 32 is provided with a pin 35 that gets into the hole 23 of said projection 22 of the first element 2 and ensures the stable coupling of the elements that make up the lock when said projection is introduced into the hollow element 31 of the second element 3 through the opening 36 made in said hollow element 31.

According to a practical application this pin 23 can be replaced with any male element, for example a plate protruding out of the cover 32 and getting into a corresponding seat, which can in this case be the already mentioned notch suitable for housing said protruding plate.

At their ends both the pin 35 and said projection 22 have blunted parts, respectively 135 and 122, the inclined surfaces of which cooperate with each other when they are pushed and put in reciprocal contact by introducing the projection 22 into the opening 36. This way first the cover 32 is raised and then the pin 35 is introduced into the hole 23 of the projection 22 when the cover returns thanks to the elastic action of the spring 5.

Figure 5:
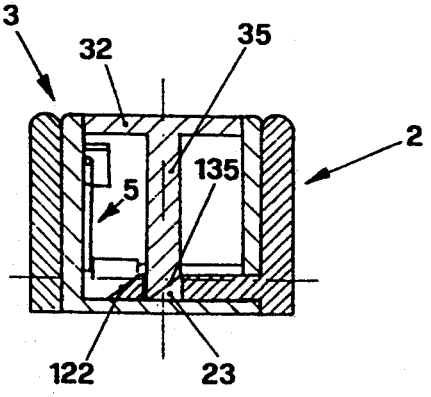
FIG. 5 shows a cross section of the lock object of the invention in closed position, carried out according to the A—A viewing plane of FIG. 4.

The coupling of the elements 2 and 3 of the lock is thus accomplished, as shown in FIG. 5, the pin 35 being introduced in the hole 23 even without having to raise the cover 32 previously.

Vice versa, in order to separate the elements that make up the lock it is necessary to voluntarily raise the cover 32, in such a way as to release the projection 22 from the coupling with the pin 35 and to reciprocally separate the elements 2 and 3 from each other.

It can be noticed that for this purpose the cover 32 has no projections, since it is raised by the user by exerting friction force on the outer surface of the cover along with upward traction force 7 suitable for causing the cover 32 itself to rotate around the hinge 33, said forces being exerted with the forefinger of the hand on the part 6 opposite to the hinge 33.

After separating the elements 2 and 3 from each other, the user releases the cover 32, which automatically lowers and returns to the hollow element 31 in closed position, through the elastic returning action of the spring 5.

Figure 4:
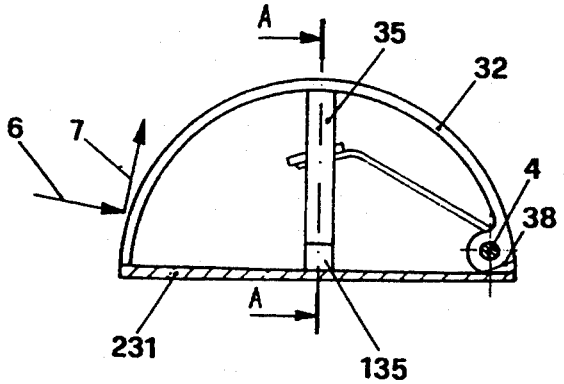
FIG. 4 shows the lock object of the invention as shown in FIG. 2, but in closed position.

In FIG. 4 it can also be noticed that in correspondence with said hinge 33 the cover 32 has an inclined plane 38 at its end and when the cover is in the position of maximum opening, as FIG. 2 shows, said inclined plane 38 is set in opposition to the bottom 231 of the hollow element 31, thus ensuring an end-of-stroke position.

Since the projection 22 and the pin 35 can be carried out in the first element 2 and in the second element 3 respectively, independently of their outer shape, the latter can have any shape fitting the geometry of the object on which the lock is mounted.

Figure 6:
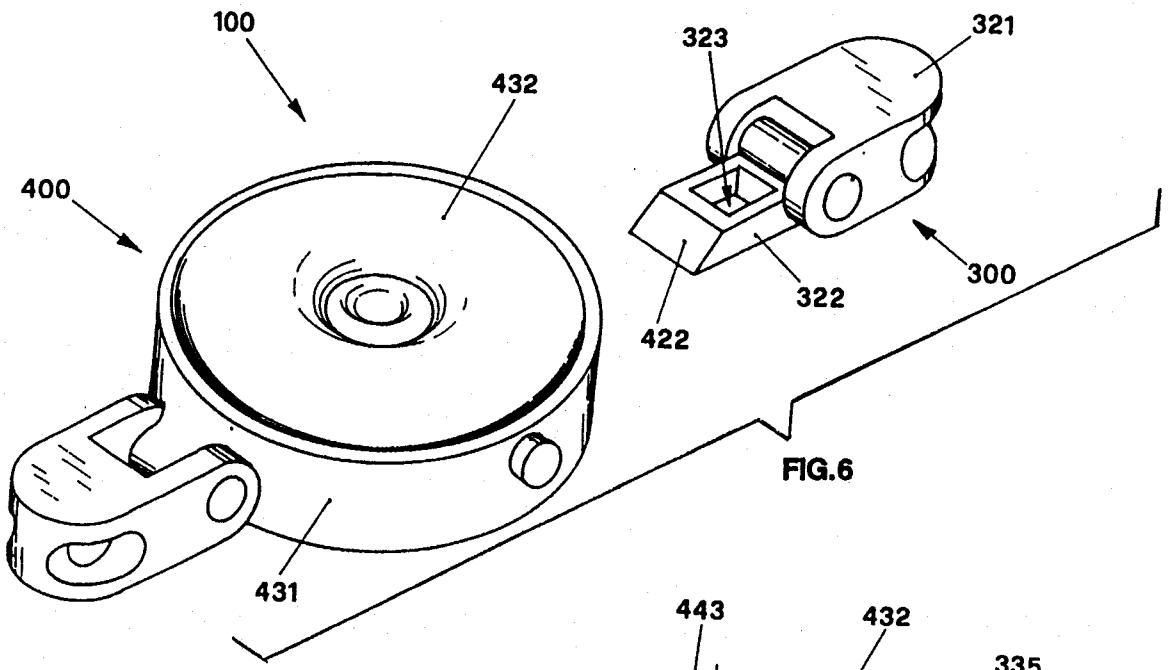
FIG. 6 shows an axonometric view of a variant of the lock object Of the invention when open.

A variant of the lock object of the invention is represented in exploded axonometry in FIG. 6, where it is referred to as a whole by 100 and where it can be noticed that, like the variant described above, it consists of a first element, referred to as a whole by 300, and of a second element, referred to as a whole by 400, each of which is linked to one end of the object by means of any linking element.

Figure 7:
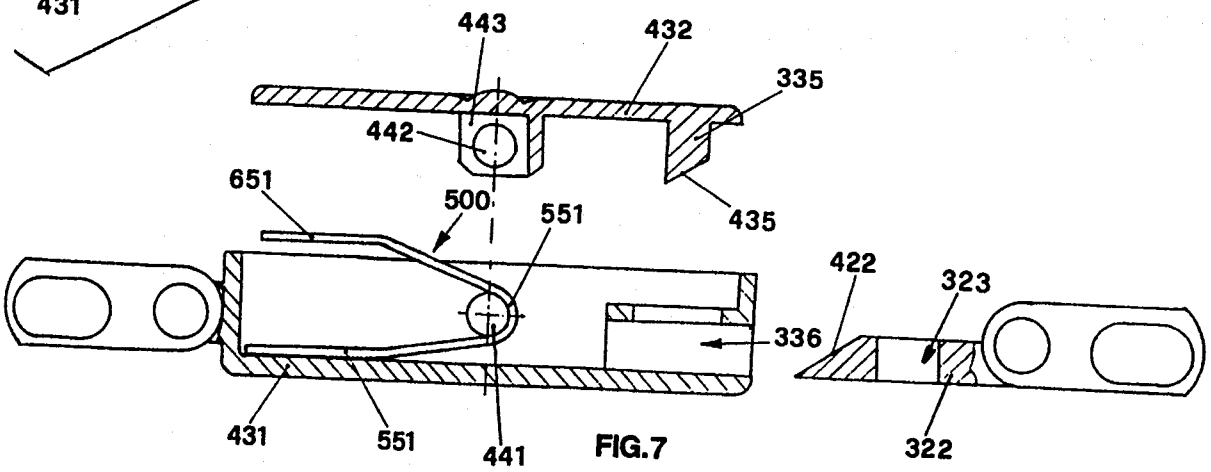
FIG. 7 shows an exploded view and a section of the variant of the lock object of the invention represented in FIG. 6.
Figure 8:
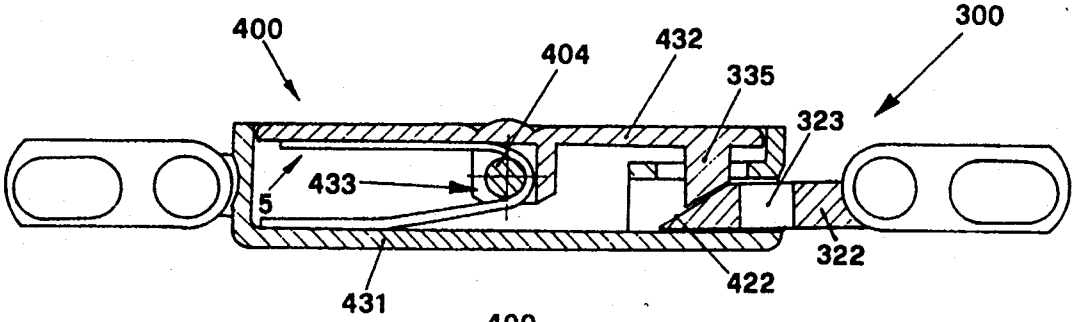
FIG. 8 shows the variant of the lock represented in FIG. 7, mounted and with the elements that make it up when coupling with each other.

Said first element 300 consists of a body 321 that can have any shape, even different from that described here, and is provided with a projection 322 with a through hole 323, while, as FIG. 7 shows, too, said second element 400 consists of a hollow element 431 cooperating with a cover 432, connected with each other by means of a hinge 433, which can be seen in detail in FIG. 8.

Said hinge 433 is placed in correspondence with a substantially central intermediate area of said lock 100 and consists of a pivot 404 driven through holes 441, which are made in the hollow body 431, and of a hole 442, which is made in a central core 443 belonging to the cover 432.

Figure 9:
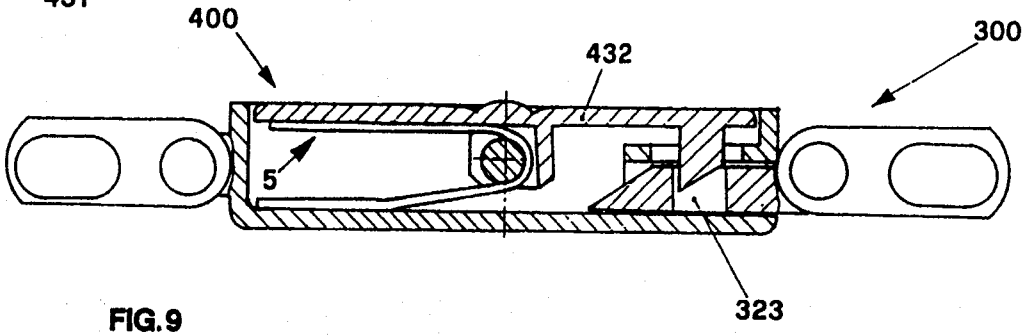
FIG. 9 shows the lock represented in FIG. 8 with the elements that make it up coupled with each other.
Figure 10:
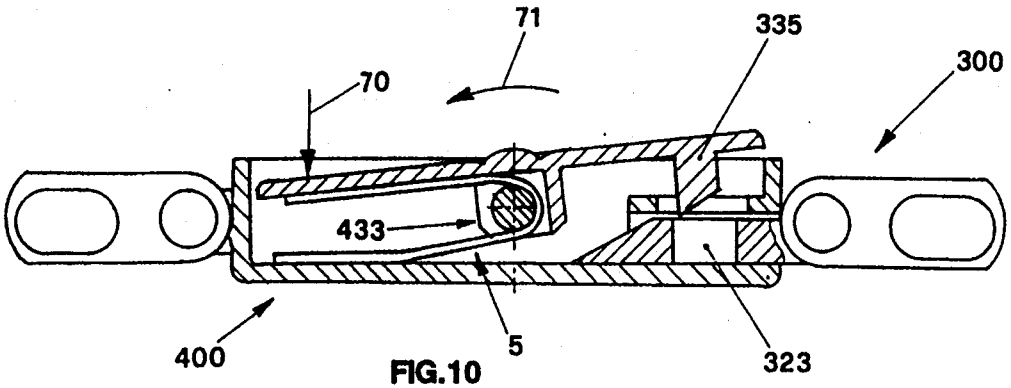
FIG. 10 shows the lock represented in FIG. 9 with the elements that make it up in their unfastening phase.

Said hinged connection is yielding due to the presence of an elastic element consisting of a spring 500, the central part 551 of which is wound in correspondence with the hinge 433, while one of its ends 551 is placed in opposition to the bottom of said hollow element 431 and the other end 651 is placed in opposition to the cover 432, as shown in FIGS. 8, 9 and 10.

Like in the previously described practical application, in its inner part facing the concave part of the hollow element 431, the cover 432 is provided with a pin 335 that gets into the hole 323 of said projection 322 of the first element 300 and ensures the stable coupling of the elements that make up the lock when said projection is introduced into the hollow element 431 of the second element 3 through the opening 336 made in the hollow element 431 itself.

For this purpose it can be noticed that both the pin 335 and said projection 322 at one end have blunted parts, respectively 435 and 422, the inclined surfaces of which cooperate with each other when they are reciprocally pushed and put in contact by inserting the projection 322 into the opening 336, as shown in detail in FIG. 8.

This way first the cover 432 is raised with a rotation around the hinge 433 and then the pin 335 is introduced into the hole 323 of the projection 322, when the elastic action of the spring 500 makes the cover return to its position.

The coupling between the elements 300 and 400 of the lock is thus achieved, as FIG. 9 shows, by means of the pin 335 introduced in the hole 323.

In order to separate the elements that make up the lock, as shown in FIG. 10, it is necessary to voluntarily exert a vertical pressure 70 downwards on the cover 432, so that said pressure, by making the cover rotate clockwise 71 around the hinge 433, releases the projection 322 from the opposition to the pin 335 and therefore allows the two elements 300 and 400 that make up the lock to be separated from each other.

It is consequently clear that also this variant, like the previously described solution, accomplishes a lock that can be opened only intentionally with a voluntary action of the user, since there are no outer clinging elements.

Further, also this variant can have any outer shape, in such a way as to allow the lock to geometrically fit any bracelet or necklace, whatever shape and dimension they should have.

Upon the implementation of any of the two variants described above, the elements that make up the lock can have any form and likewise the inner elastic element that ensures the fastening of the lock itself when the two elements making it up are coupled can have any form as well.

Moreover the shape, the dimensions and, if necessary, even the number of the projections 22 and of the pins 35, which ensure the stable coupling of said elements, can also vary. All said variants and any other variant that should be necessary are in any case to be considered protected by the present invention.

I claim:

1. A lock for jewellery comprising:

a first connecting element having a projection formed with a seat and a first cam surface;

a second connecting element having an opening for receiving the projection therein, said second connecting element including a hollow body; a cover mounted in the hollow body, relatively movable for rotation therein between open and closed positions; a hinge for connecting the cover to the hollow body; and a spring interposed between the cover and the body for maintaining the cover and body based in the closed position said cover including a male element formed with a second cam surface extending therefrom for mating with the seat and for engaging the first cam surface of the projection when received in the opening to urge the cover towards the open position, to allow the first and second cams to move relative to each other, and to thereafter allow the second cam surface to mate with the seat in said projection in order to achieve stable connection of said first and second connecting elements when said projection is inserted into the opening and when spring urges said cover to close against said hollow element by rotation around said hinge after said projection has been introduced into said opening.

2. A lock according to claim 1 wherein said male element comprises a pin and the seat is in the form of a hole formed in said projection.

3. A lock according to claim 1 wherein said hinge is located at an end of said second element.

4. A lock according to claim 1 wherein said hinge is located centrally of said second connecting element.

5. A lock according to claim 1 wherein said hinge comprises a pivot formed between the cover and the hollow element having coupling holes therein, and a pin securing the hollow element and the cover.

6. A lock according to claim 1 wherein the spring and the hinge are located at an end of said cover and act in opposition to said hollow element at an opposite end thereof.

7. A lock according to claim 1 wherein the spring and the hinge are located centrally of the cover, the spring extends toward an end of the cover and acts in opposition to the bottom of said hollow body and a central volute is located in correspondence with the hinge.

8. A lock according to claim 1 including an inclined plane located at an end of the cover for engaging the bottom of said hollow element when said cover is in raised position with respect to said hollow element.

9. A lock according to claim 1 wherein the projection engages the hollow body transversely.

10. A lock according to claim 1 wherein the projection engages the hollow body in radially.

11. A lock according to claim 1 wherein the first and second cam elements each comprise an inclined plane.

12. A lock according to claim 1 wherein the seat comprises an opening formed in the projection having inclined wall portions.

* * * * *